United States Patent [19]

Yamazaki et al.

[11] Patent Number: 4,893,151

[45] Date of Patent: Jan. 9, 1990

[54] IMAGE DEVELOPING APPARATUS

[75] Inventors: Mutsuki Yamazaki, Yokohama; Kaoru Oshima, Tokyo; Toshimasa Takano, Sagamihara, all of Japan

[73] Assignee: Kabushiki Kaisha Toshiba, Kawasaki, Japan

[21] Appl. No.: 276,416

[22] Filed: Nov. 25, 1988

[30] Foreign Application Priority Data

| | | | |
|---|---|---|---|
| Nov. 26, 1987 | [JP] | Japan | 62-296022 |
| Nov. 30, 1987 | [JP] | Japan | 62-302011 |
| Nov. 30, 1987 | [JP] | Japan | 62-302015 |
| Nov. 30, 1987 | [JP] | Japan | 62-302016 |

[51] Int. Cl.[4] ..... G03G 15/08

[52] U.S. Cl. ..... 355/245; 355/200; 118/653; 430/107; 430/120

[58] Field of Search ..... 355/245, 200, 246, 254; 118/653, 600; 430/120, 107, 109, 111

[56] References Cited

U.S. PATENT DOCUMENTS

| | | | |
|---|---|---|---|
| 4,505,573 | 3/1985 | Brewington et al. | 118/653 X |
| 4,637,708 | 1/1987 | Yuasa | 355/245 X |
| 4,666,801 | 5/1987 | Kimura et al. | 118/653 X |
| 4,696,255 | 9/1987 | Yano et al. | 118/653 |
| 4,748,474 | 5/1988 | Kurematsu et al. | 355/245 |

*Primary Examiner*—A. C. Prescott

*Attorney, Agent, or Firm*—Foley & Lardner, Schwartz, Jeffery, Schwaab, Mack, Blumenthal & Evans

[57] ABSTRACT

An image developing apparatus capable of developing high quality images without a fog and a toner density fluctuation over an extended period of time while reducing a driving torque in an image developing operation is disclosed. The image developing apparatus may includes a toner conveyer device having its surface coated with a ceramic for conveying non-magnetic single component toner to the image bearer in order to develop the latent image, and a lamination controller device for controlling a thickness of non-magnetic single component toner lamina to be formed on the toner conveyer device. The image developing apparatus may includes a toner conveyer device for conveying non-magnetic single component toner to the image bearer in order to develop the latent image, and a lamination controller device having its surfaces coated with a ceramic for controlling a thickness of non-magnetic single component toner lamina to be formed on the toner conveyer device.

20 Claims, 4 Drawing Sheets

IMAGE DEVELOPING APPARATUS

BACKGROUND OF THE INVENTION

1. Field of the Invention

The present invention relates to an image developing apparatus to be incorporated, for example, in a copy machine, for developing a latent image by means of a toner and, more particularly, to such an image developing apparatus capable of developing high quality images without a fog and a toner density fluctuation over an extended period of time while reducing a driving torque in an image developing operation.

2. Description of the Prior Art

A conventional image forming apparatus such as a copy machine is normally equipped with an image developing apparatus which utilizes a toner of binary system or of magnetic single component system as a developer, in order to develop a latent image formed on a photosensitive body.

However, such an image developing apparatus has a drawback of being difficult to convert to a color image developing apparatus due to the fact that a fine control of toner-carrier ratio is necessary for the binary system toner whereas the magnetic single component toner contains magnetic bodies of dark complexion. Moreover, it is necessary to equip such a conventional image developing apparatus with an expensive magnetic roller as a developing roller which functions as a toner conveying means.

To cope with this situation, there is a recent proposition to use a non-magnetic single component toner. An image developing apparatus using such a non-magnetic single component toner incorporates a hopper equipped with a mixer and a toner supply roller which supplies a toner to a developing roller by means of their rotational motion, and an elastic blade which functions as a lamination controlling means, to be placed around the developing roller in order to form a toner lamina of approximately 30 μm thickness on the developing roller. The latent image on a photosensitive body which is an image bearer is developed by placing this toner lamina in a proximity of the photosensitive body.

In such an image developing apparatus using a non-magnetic single component toner, the toner is of positively electrifiable type which has an electrification of approximately +12 μC/g after being laminated, as oppose to the negatively electrifiable photosensitive body. This manner of developing the latent images is in principle that using a highly resistive single component toner, so that the electrification of the toner is accomplished by means of the electrification due to a friction between the developing roller and the elastic blade. In this case, a magnetic roller is not necessary because the conveying of the toner is accomplished by means of the rotational motion of the developing roller. Thus, this image developing apparatus using a non-magnetic single component toner has been considered to be capable of developing high quality images by a simple configuration, inexpensively, and is suitable for converting into a color image developing apparatus.

However, it has been realized that this image developing apparatus using a non-magnetic single component toner is also associated with problems. In a first place, abrasion of the developing roller and the elastic blade causes an considerable amount of the reduction of the image density as well as the blurring of the letters after an extensive use. Secondly, a large friction between the toner and the elastic blade made of a metal or a rubber causes an increase of a driving torque in an image developing operation. Thirdly, the quality of the image is uneven depending on the types of the toner, such that a fog tends to be produced when the poorly electrifiable toner is used, while the image density tends to lower when a highly electrifiable toner is used.

SUMMARY OF THE INVENTION

It is therefore an object of the present invention to provide an image developing apparatus capable of developing high quality images without a fog and a toner density fluctuation over an extended period of time while reducing a driving torque in an image developing operation.

According to one aspect of the present invention there is provided an image developing apparatus, comprising: image bearer means for bearing a latent image; toner conveyer means for conveying non-magnetic single component toner to the image bearer means in order to develop the latent image, the toner conveyer means having its surface coated with a ceramic; and lamination controller means for controlling a thickness of non-magnetic single component toner lamina to be formed on the toner conveyer means.

According to another aspect of the present invention there is provided an image developing apparatus, comprising: image bearer means for bearing a latent image; toner conveyer means for conveying non-magnetic single component toner to the image bearer means in order to develop the latent image; and lamination controller means for controlling a thickness of non-magnetic single component toner lamina to be formed on the toner conveyer means, the lamination controller means having its surface coated with a ceramic.

Other objects and features of the present invention will become apparent from the following description taken in conjunction with the accompanying drawings.

DETAILED DESCRIPTION OF THE PREFERRED EMBODIMENTS

Figure 1:
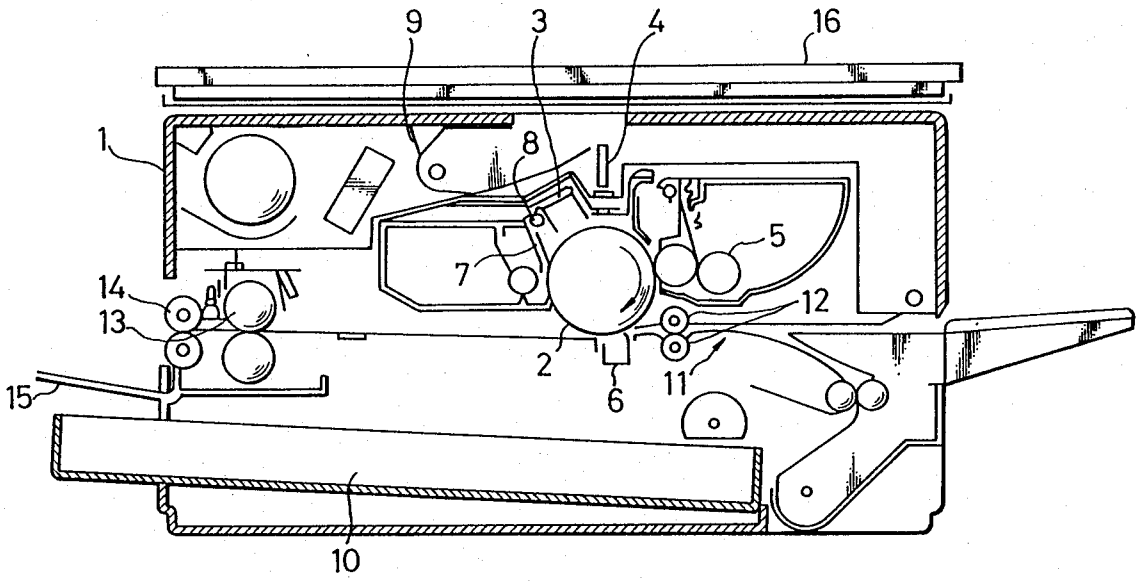
FIG. 1 is a schematic sectional view of an electronic copy machine incorporating one embodiment of an image developing apparatus according to the present invention.

Referring now to FIG. 1, there is shown an electronic copy machine incorporating one embodiment of an image developing apparatus according to the present invention.

In FIG. 1, near the center of a main body 1, there is provided a photosensitive body 2, rotatable in the direction indicated by an arrow, which functions as a image bearer. Surrounding this photosensitive body 2 are an electrifying device 3, an imaging lens 4, an image developing apparatus 5 to be explained in detail below, a printing device 6, a cleaner 7, and a de-electrifying device 8. On an upper part of the main body 1, there is provided an optical system 9 for illuminating a manuscript, and on a lower part of the main body 1, there is a paper supply cassette 10. Papers supplied from the paper supply cassette 10 are carried by a carrier means 11 along which there is provided a resist-roller 12, a fixing device 13, and a paper ejection roller 14. The main body 1 is further equipped with a paper ejection tray 15 and the manuscript table 16.

This copy machine operates as follows. A manuscript placed on the manuscript table 16 is illuminated by the illumination light from the optical system 9, and the reflections of this illumination light are focused by the imaging lens 4 on the photosensitive body 2 which bears a latent image of the manuscript as a consequence. Then the non-magnetic single component toner (referred hereafter simply as the toner) is supplied by the image developing apparatus 5 to this latent image in order to visualize it. Meanwhile, a paper is supplied from the paper supply cassette 10 in between the photosensitive body 2 and the printing device 6 which prints the visualized image carried by the photosensitive body 2 on the paper. The printed paper then is carried by the carrier means 11 to the fixing device 13 where the printed image is fixed, and ejected through the paper ejection roller 14 to the paper ejection tray 15.

Figure 2:
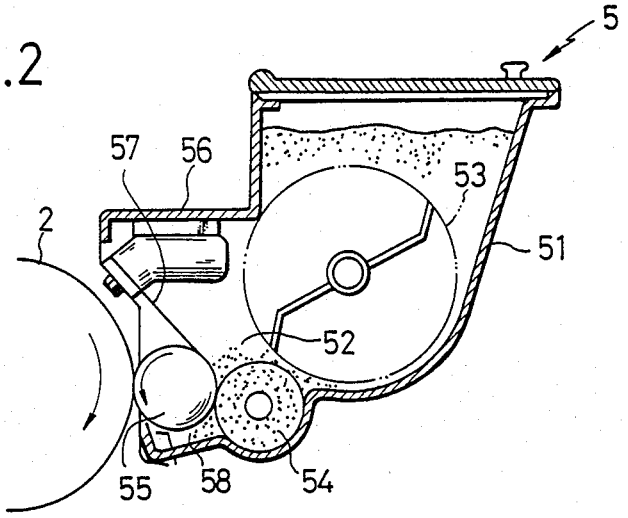
FIG. 2 is a schematic sectional view of the image developing apparatus.
Figure 3:
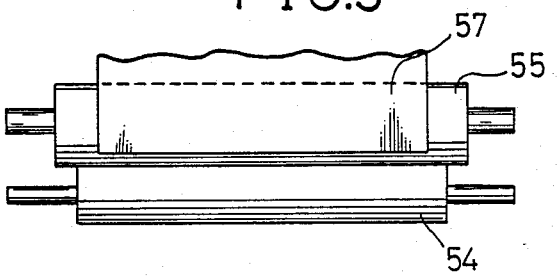
FIG. 3 is a vertical views of a developing roller, a toner supply roller, and an elastic blade of the image developing apparatus shown in FIG. 2.
Figure 4:
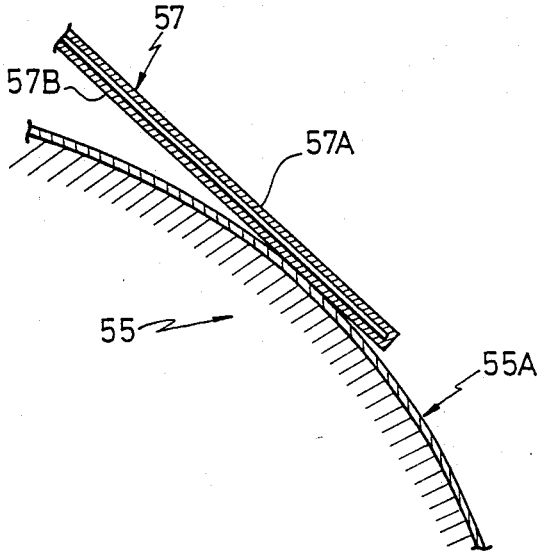
FIG. 4 is an enlarged sectional view of the developing roller and the elastic blade of the image developing apparatus shown in FIG. 2.

Referring now to FIGS. 2 to 4, the detail of the image developing apparatus 5 will be explained.

In FIG. 2, the image developing apparatus 5 comprises a hopper 51 which contains the toner 52. This hopper 51 is equipped with a mixer 53 for stirring the toner 52 contained in the hopper 51, a developing roller 55 which rotates in the direction indicated by an arrow that is opposite of the direction of the rotation of the photosensitive body 2 and which functions as a toner conveyer, a toner supply roller 54 adjacent to the developing roller 55 which supplies the toner to the developing roller 55 and which rotates in the direction opposite to that of the developing roller 55, an elastic blade 57 which is kept electrically conducting through the holder 56 and which is in contact with an upper side of the developing roller 55 to exert an approximately 20 to 500 g/cm of pressure in order to function as a lamination controller, and an exfoliation blade 58 which is in contact with a lower side of the developing roller 55 to scrape off an unused toner from the developing roller 55. The developing roller 55 can rotate at any speed between that of the photosensitive body 2 and the three times that speed and can accelerate within that range by means of a driving means which is not shown. Also, there is a voltage bias applied between the developing roller 55 and the photosensitive body 2 of either a direct bias, an alternating bias, or the combination of these two.

This image developing apparatus operates as follows. The toner 52 contained in the hopper 51 is stirred by the mixer 53 and carried by the toner supply roller 54 to be rubbed on the developing roller 55. This toner 52 on the developing roller 55 is laminated at a predetermined thickness and electrified by means of the elastic blade 57. The sufficiently electrified toner 52 is then brought to the position to face the photosensitive body 2 and visualizes the latent image formed on this photosensitive body 2. A portion of the toner 52 not used in developing the latent image is scraped off from the developing roller by the exfoliation blade 58 and returns to the hopper 51.

Now, with such a configuration, the image developing apparatus of the present invention is characterized in that at least one of the developing roller 55 and the elastic blade 57 is coated with a ceramic which includes at least one of aluminium (Al), boron (B), carbon (C), germanium (Ge), silicon (Si), titanium (Ti), and tungsten (W). Namely, as shown in FIG. 4, in this image developing apparatus 5 the developing roller 55 is coated with a ceramic 55A of an uniform thickness while the elastic blade 57 is coated with another ceramic 57A and 57B also of an uniform thickness but not necessarily of the same type as that for the developing roller.

A ceramic is a kind of a heat resistant porcelain enamel and normally comprises mainly of an aluminium oxide, a silicon oxide, a chromium oxide, and a clay. Kinds of ceramics which include at least one of Al, B, C, Ge, Si, Ti and W are particularly hard, highly abrasion resistive and very insulative, so that the coating the developing roller 55 and the elastic blade 57 with such ceramics can effectively reduce the abrasion of these parts and prevent the contamination of the interior parts of the copy machine due to the scattering off of the unused toner from the developing roller 55. Moreover, the ceramics including at least one of Al, B, and C can electrify the toner very well so that a rather poorly electrifiable toner can be used, whereas the ceramics including at least one of Ge and Si can have variable electric resistances so that they can be adjusted in accordance with the electrifiability of the toner. This latter type of ceramics are also characterized by that the toner can easily be rubbed on and the image density can be made large. On the other hand, the ceramics including at least one of the Ti and W are characterized by that the image density can also be made large, and this type of the ceramics are good conductors.

As stated above, the ceramics to be used in the present invention must include at least one of Al, B, C, Ge, Si, Ti, and W. As for the other ingredients, any of nitrogen (N), oxygen (0), hydrogen (H), and halogen are desirable and, in particular, 1 to 40 atomic% of either H or halogen is preferable.

Also as stated above, the coating by such ceramics must be done for at least one of the developing roller 55 and the elastic blade 57 in order to obtain the significant effect of the present invention, and coating both of these parts can obviously improve the effect further. When one of these parts is to be coated with one type of the ceramics mentioned above, the other one of these parts can be coated with any one of the other types ceramics mentioned above, in which case advantages coming from the different types of the ceramics may be enjoyed simultaneously.

Also, as shown in FIG. 4, the coating of the elastic blade 57 is preferably done on both sides of the elastic blade 57 in order to avoid causing a deformation of the elastic blade 57.

Referring now to FIGS. 5 to 8, methods of coating the ceramics on the developing roller 55 and the elastic roller 57 will be explained.

In general, for coating the ceramics there are methods such as sputtering, ion-plating, vacuum evaporation, plasma CVD, ECR plasma CVD, thermal CVD, and optical CVD. Among these the sputtering and the plasma CVD are recommended for the purpose of the present invention because in these two methods, the coated layer has a firmer contact, the temperature required is relatively low, the properties of the base material are unaffected, and the electrical and the optical properties of the coated layer are controllable.

Figure 5:
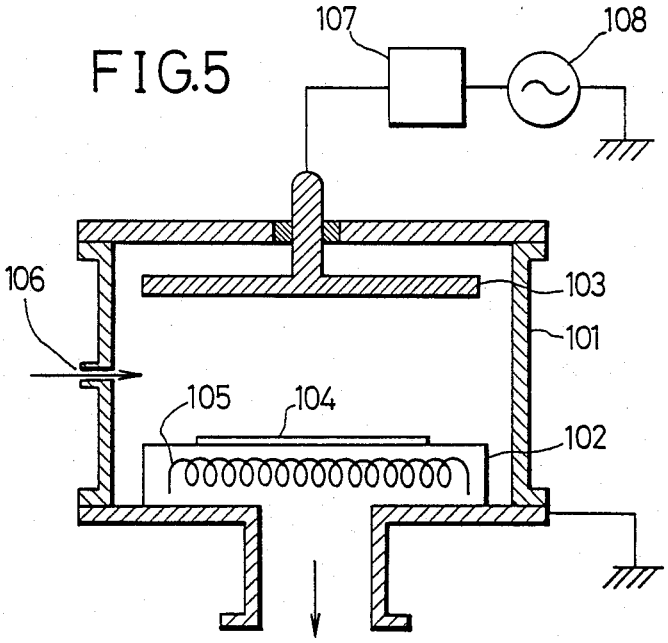
FIG. 5 is a schematic sectional view of a plasma CVD coating apparatus to be employed for coating ceramics on the elastic blade.

FIG. 5 shows a plasma CVD coating apparatus for the coating of the elastic blade 57, which is a parallel-plate, capacity-connected type of plasma CVD apparatus.

In this plasma CVD apparatus shown in FIG. 5, inside a vacuum chamber 101 there is provided a grounded plate electrode 102 and a high frequency electrode 103 facing to each other, and a base material 104 such as a metallic elastic blade is to be placed on top of the grounded plate electrode 102. The vacuum chamber 101 is evacuated to be at approximately $10^{-3}$ Torr by means of a vacuum pump not shown, and then the base material 104 is heated up to approximately 150°–450° C. by means of a heater 105 installed in the grounded plate electrode 102. After that, ingredient gases are injected into the vacuum chamber 101 through a gas injection opening 106 while continuing to evacuate the vacuum chamber 101 to maintain its pressure inside at 0.05–1.0 Torr, and the power is supplied from a high frequency power source 108 through a matching box 107 to the high frequency electrode 103. As a result, the glow discharge is induced between the grounded plate electrode 102 and the high frequency electrode 103, and the ingredient gases turned into the plasma state by the glow discharge form a thin ceramic layer on the surface of the base material 104.

Figure 6:
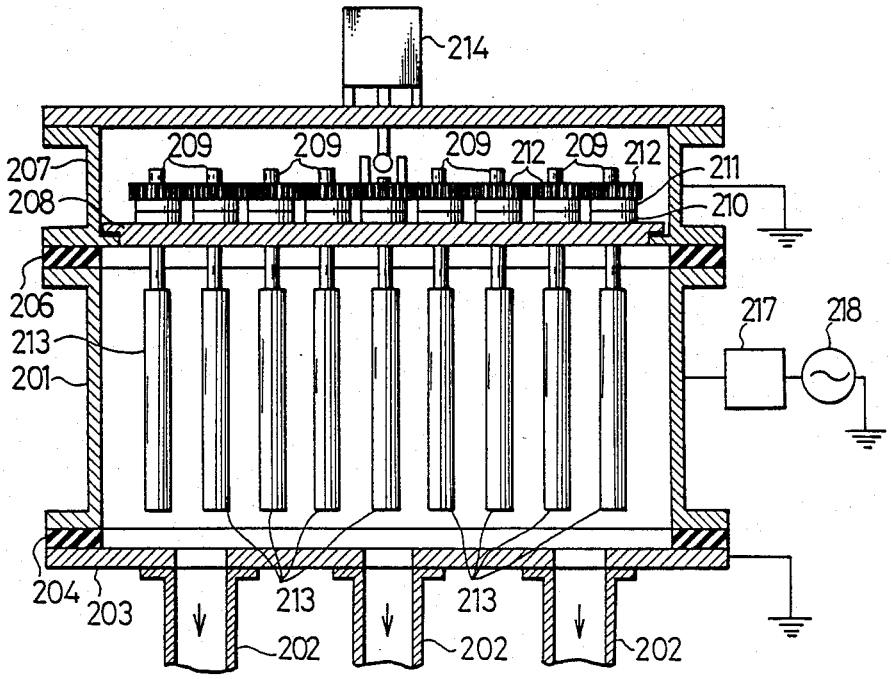
FIG. 6 is a schematic vertical sectional view of a plasma CVD coating apparatus to be employed for coating ceramics on the developing roller.
Figure 7:
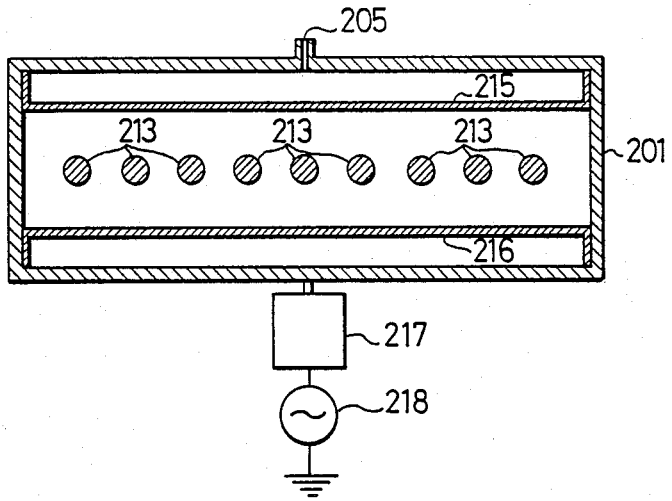
FIG. 7 is a schematic horizontal sectional view of the plasma CVD coating apparatus shown in FIG. 6.

FIGS. 6 and 7 shows the plasma CVD coating apparatus for the coating of the developing roller 55.

In this plasma CVD apparatus shown in FIGS. 6 and 7, inside of a reaction chamber 201 is maintained at approximately $10^{-3}$ Torr by evacuating through evacuation openings 202 by means of a mechanical booster pump not shown. On the back of the reaction chamber 201 there is a gas injection opening 205 through which the ingredient gases are injected, and on the top of the reaction chamber 201 there is a storing chamber 207 which is electrically insulated by an insulator 206 and separated by a separation plate 208 from the reaction chamber 201. Through the separation plate 208 there are a plurality of supporting rods 209 each of which is fastened to the separation plate 208 vertically by means of collars 210. On the upper ends of the supporting rods 209 there are gears 212 each of which is fastened to the one of the supporting rods 209 by means of one of holders 211 and is clutched with its adjacent gears so that when the central gear is driven by the driving device 214 all of the gears 211 and hence all the supporting rods 209 rotate. On the lower end of the supporting rods 209, there are developing rollers 55 suspended by means of screws not shown so that as the supporting rods 209 rotate the developing rollers 55 also rotate. As shown in FIGS. 6 and 7, the developing rollers 55 are arranged in line in the middle of the reaction chamber 201 and in front and back of these developing rollers 55 there is a pair of the plate electrodes 215 and 216, respectively. These plate electrodes 215 and 216 have numerous holes so that the ingredient gases entering from the gas injection opening 205 can spread throughout the inside of the reaction chamber 201, and are maintained at the same voltage as the walls of the reaction chamber 201.

The coating of the ceramics by this plasma CVD apparatus is carried out by rotating the developing rollers 55 at the constant speed and controlling the pressure inside the reaction chamber 201 at approximately 0.1–1.0 Torr, then applying the high frequency power from a high frequency power source 218 through a matching box 217. As a result, since the developing rollers 55 are grounded through the storing chamber 207, the glow discharge is induced between the plate electrodes 215 and 216 and the ingredient gases turned into the plasma state by the glow discharge form a thin and uniform ceramic layer on the surface of each of the developing rollers 55.

Various different kinds of the ceramics mentioned above can be coated by these plasma CVD apparatuses just explained by using different ingredient gases.

Thus, to obtain the coating by the ceramics including Al in a form of $Al_2O_3$ or AlN, the ingredient gases comprising $Al(CH_3)_3$ or $Al(CH_5)_3$, as well as $N_2$, $O_2$, and $NH_3$ can be used. In this case, as either of $Al(CH_3)_3$ or $Al(CH_5)_3$ has relatively low vapor pressure, it is more practical to expel such gas from its container by injecting the $H_2$ into it. Consequently, $H_2$ may also be present inside the vacuum chamber 101 or the reaction chamber 201.

To obtain the coating by the ceramics including B in a form of BN or BC, the ingredient gases comprising $B_2H_6$, $BF_3$, or $BCl_3$, as well as $N_2$, $NH_3$, $CH_4$, and $C_2H_6$ can be used.

To obtain the coating by the ceramics including C in a form of diamond, graphite, carbon polymer film, or amorphous carbon, the ingredient gases comprising hydrocarbon such as $CH_4$, $C_2H_6$, or $C_2H_2$ as well as $H_2$ can be used.

On the other hand, by using the ingredient gas comprising only $SiH_4$, the ceramic of amorphous silicon can be obtained, and by further mixing a gas containing a metal atom selected from the III and V groups of the periodic table such as $B_2$, $H_6$, or $PH_3$, the valence electrons can be controlled such that the electrical resistance can be varied within the range of $10^3$–$10^{13}$ cm so that the resistivity and the conductance of the ceramic can be selected in accordance with the electrifiability and other characteristics of the toner to be used. Also, by mixing $N_2$ or $NH_3$ to $SiH_4$, the amorphous silicon nitride can be obtained, whereas by mixing $O_2$ or $N_2O$ to $SiH_4$, the amorphous silicon oxide can be obtained. A mixture of these such as that of $SiH_4$, $CH_4$, and $N_2$ may also be used to obtain the amorphous silicon carbide containing nitrogen.

Among the ceramics including Si mentioned so far, the amorphous silicon possesses the smallest optical band gap and resistivity, followed by silicon carbide, silicon nitride, silicon oxide in increasing order. Also, the mechanical strength varies significantly among these, such that in the Vickers hardness scale the amorphous silicon is 1000, silicon carbide is 2500, silicon nitride is 2000, and the silicon oxide is 1500.

Similarly, by using the ingredient gas comprising only $GeH_4$, the ceramic of amorphous germanium can be obtained, and by further mixing a gas containing a metal atoms from the III and V groups of the periodical table such as $B_2$, $H_6$, or $PH_3$, the valence electrons can be controlled as for the case of $SiH_4$ explained above. Likewise, the compounds such as germanium nitride, germanium carbide, and germanium oxide can be obtained in the manner similar to that for $SiH_4$. However, those ceramics including Ge tends to have a weaker mechanical strength and smaller optical band gap and resistivity compared with those ceramics including Si.

As for obtaining the ceramics including Ti in a form of TiN, the ingredient gases comprising $TiCl_4$, $N_2$, and $H_2$ can be used. Of these ceramics including Ti, amorphous, carbide, nitride, and oxide have in this order the increasing value of the resistivity, whereas carbide, nitride, oxide, and amorphous have in this order the decreasing mechanical strength. The same remarks made on the ceramics including Ti can also apply to the ceramics including W.

In all of the ceramics mentioned above, the hardness of the ceramics can significantly be increased by reducing the amount of H or halogen included in the ingredient gases, and the mechanical strength and the resistivity of the ceramics can significantly be varied according to the amount of C, N, and 0 contained in the ingredient gases.

The various ingredient gases that can be used in the plasma CVD coating for the purpose of the present invention along with the exemplary conditions to be used for each are summarized in the following table 1.

TABLE 1

| No. | Ceramics | Ingredient gases | Gas flow rate (SCCM) | Pressure (Torr) | Power (W) | Resistivity (cm) |
|---|---|---|---|---|---|---|
| 1 | TiN | $TiCl_4$ | 50 | 1.0 | 400 | — |
| | | $N_2$ | 200 | | | |
| | | $H_2$ | 1000 | | | |
| 2 | TiC | $TiCl_4$ | 50 | 1.0 | 400 | — |
| | | $CH_4$ | 100 | | | |
| | | $H_2$ | 1000 | | | |
| 3 | TiCN | $TiCl_4$ | 50 | 1.0 | 400 | — |
| | | $CH_4$ | 50 | | | |
| | | $N_2$ | 100 | | | |
| | | $H_2$ | 1000 | | | |
| 4 | WC | $WF_6$ | 50 | 1.0 | 400 | — |
| | | $CH_4$ | 100 | | | |
| | | $H_2$ | 1000 | | | |
| 5 | $Al_2O_3$ | $Al(CH_3)_3$ | 30 | 1.0 | 400 | — |
| | | $O_3$ | 100 | | | |
| | | $H_2$ | 1000 | | | |
| 6 | AlN | $Al(CH_3)_3$ | 30 | 1.0 | 400 | — |
| | | $N_2$ | 200 | | | |
| | | $H_2$ | 1000 | | | |
| 7 | Diamond | $CH_4$ | 10 | 5.0 | 1K | — |
| | | $H_2$ | 500 | | | |
| 8 | Graphite | $CH_4$ | 50 | 1.0 | 500 | — |
| | | $H_2$ | 200 | | | |
| 9 | BN | $B_2H_6$ | 10 | 1.0 | 200 | — |
| | | He | 200 | | | |
| | | $N_2$ | 400 | | | |
| 10 | BC | $B_2H_6$ | 10 | 1.0 | 200 | — |
| | | He | 200 | | | |
| | | $CH_3$ | 100 | | | |
| 11a | Amorphous Si | $SiH_4$ | 100 | 1.0 | 100 | $10^{10}$ (i-type) |
| 11b | | $SiH_4$ | 100 | 1.0 | 100 | $10^7$ (p-type) |
| | | $B_2H_6/SiH_4$ | $1 \times 10^{-5}$ | | | |
| 11c | | $SiH_4$ | 100 | 1.0 | 100 | $10^4$ (p-type) |
| | | $B_2H_6/SiH_4$ | $1 \times 10^{-2}$ | | | |
| 11d | | $SiH_4$ | 100 | 1.0 | 100 | $10^7$ (n-type) |
| | | $PH_3/SiH_4$ | $1 \times 10^{-5}$ | | | |
| 11e | | $SiH_4$ | 100 | 1.0 | 100 | $10^4$ (n-type) |
| | | $PH_3/SiH_4$ | $1 \times 10^{-2}$ | | | |
| 12a | Amorphous SiC | $SiH_4$ | 100 | 1.0 | 100 | $10^{13}$ (i-type) |
| | | $CH_4$ | 200 | | | |
| 12b | | $SiH_4$ | 100 | 1.0 | 100 | $10^9$ (p-type) |
| | | $CH_4$ | 200 | | | |
| | | $B_2H_6/SiH_4$ | $1 \times 10^{-5}$ | | | |
| 12c | | $SiH_4$ | 100 | 1.0 | 100 | $10^6$ (p-type) |
| | | $CH_4$ | 200 | | | |
| | | $B_2H_6/SiH_4$ | $1 \times 10^{-2}$ | | | |
| 12d | | $SiH_4$ | 100 | 1.0 | 100 | $10^9$ (n-type) |
| | | $CH_4$ | 200 | | | |
| | | $PH_3/SiH_4$ | $1 \times 10^{-5}$ | | | |
| 12e | | $SiH_4$ | 100 | 1.0 | 100 | $10^6$ (n-type) |
| | | $CH_4$ | 200 | | | |
| | | $PH_3/SiH_4$ | $1 \times 10^{-2}$ | | | |
| 13 | Amorphous SiN | $SiH_4$ | 50 | 1.0 | 300 | $10^{13}$ (i-type) |
| | | $N_2$ | 800 | | | |
| | | $SiH_4$ | 50 | 1.0 | 300 | $10^9$ (p-type) |
| | | $N_2$ | 800 | | | |
| | | $B_2H_6/SiH_4$ | $1 \times 10^{-4}$ | | | |
| | | $SiH_4$ | 100 | 1.0 | 300 | $10^6$ (p-type) |
| | | $N_2$ | 800 | | | |
| | | $B_2H_6/SiH_4$ | $1 \times 10^{-1}$ | | | |
| | | $SiH_4$ | 100 | 1.0 | 300 | $10^9$ |

TABLE 1-continued

| No. | Ceramics | Ingredient gases | Gas flow rate (SCCM) | Pressure (Torr) | Power (W) | Resistivity (cm) |
|---|---|---|---|---|---|---|
| | | $N_2$ | 800 | | | (n-type) |
| | | $PH_3/SiH_4$ | $1 \times 10^{-4}$ | | | |
| | | $SiH_4$ | 100 | 1.0 | 300 | $10^6$ |
| | | $N_2$ | 800 | | | (n-type) |
| | | $PH_3/SiH_4$ | $1 \times 10^{-1}$ | | | |
| 14 | Amorphous SiO | $SiH_4$ | 100 | 1.0 | 100 | $10^{14}$ |
| | | $O_2$ | 200 | | | (i-type) |
| | | $SiH_4$ | 100 | 1.0 | 100 | $10^{10}$ |
| | | $O_2$ | 200 | | | (p-type) |
| | | $B_2H_6/SiH_4$ | $1 \times 10^{-5}$ | | | |
| | | $SiH_4$ | 100 | 1.0 | 100 | $10^7$ |
| | | $O_2$ | 200 | | | (p-type) |
| | | $B_2H_6/SiH_4$ | $1 \times 10^{-2}$ | | | |
| | | $SiH_4$ | 100 | 1.0 | 100 | $10^{10}$ |
| | | $O_2$ | 200 | | | (n-type) |
| | | $PH_3/SiH_4$ | $1 \times 10^{-5}$ | | | |
| | | $SiH_4$ | 100 | 1.0 | 100 | $10^7$ |
| | | $O_2$ | 200 | | | (n-type) |
| | | $PH_3/SiH_4$ | $1 \times 10^{-2}$ | | | |
| 15 | Amorphous Ge | $GeH_4$ | 100 | 1.0 | 100 | $10^7$ |
| | | | | | | (i-type) |
| | | $GeH_4$ | 100 | 1.0 | 100 | $10^5$ |
| | | $B_2H_6/GeH_4$ | $1 \times 10^{-5}$ | | | (p-type) |
| | | $GeH_4$ | 100 | 1.0 | 100 | $10^3$ |
| | | $B_2H_6/GeH_4$ | $1 \times 10^{-2}$ | | | (p-type) |
| | | $GeH_4$ | 100 | 1.0 | 100 | $10^5$ |
| | | $PH_3/GeH_4$ | $1 \times 10^{-5}$ | | | (n-type) |
| | | $GeH_4$ | 100 | 1.0 | 100 | $10^3$ |
| | | $PH_3/GeH_4$ | $1 \times 10^{-2}$ | | | (n-type) |
| 16 | Amorphous GeC | $GeH_4$ | 100 | 1.0 | 100 | $10^{10}$ |
| | | $CH_4$ | 200 | | | (i-type) |
| | | $GeH_4$ | 100 | 1.0 | 100 | $10^8$ |
| | | $CH_4$ | 200 | | | (p-type) |
| | | $B_2H_6/GeH_4$ | $1 \times 10^{-5}$ | | | |
| | | $GeH_4$ | 100 | 1.0 | 100 | $10^5$ |
| | | $CH_4$ | 200 | | | (p-type) |
| | | $B_2H_6/GeH_4$ | $1 \times 10^{-2}$ | | | |
| | | $GeH_4$ | 100 | 1.0 | 100 | $10^8$ |
| | | $CH_4$ | 200 | | | (n-type) |
| | | $PH_3/GeH_4$ | $1 \times 10^{-5}$ | | | |
| | | $GeH_4$ | 100 | 1.0 | 100 | $10^5$ |
| | | $CH_4$ | 200 | | | (n-type) |
| | | $PH_3/GeH_4$ | $1 \times 10^{-2}$ | | | |
| 17 | Amorphous GeN | $GeH_4$ | 50 | 1.0 | 300 | $10^{10}$ |
| | | $N_2$ | 800 | | | (i-type) |
| | | $GeH_4$ | 50 | 1.0 | 300 | $10^8$ |
| | | $N_2$ | 800 | | | (p-type) |
| | | $B_2H_6/GeH_4$ | $1 \times 10^{-4}$ | | | |
| | | $GeH_4$ | 50 | 1.0 | 300 | $10^5$ |
| | | $N_2$ | 800 | | | (p-type) |
| | | $B_2H_6/GeH_4$ | $1 \times 10^{-1}$ | | | |
| | | $GeH_4$ | 50 | 1.0 | 300 | $10^8$ |
| | | $N_2$ | 800 | | | (n-type) |
| | | $PH_3/GeH_4$ | $1 \times 10^{-4}$ | | | |
| | | $GeH_4$ | 50 | 1.0 | 300 | $10^5$ |
| | | $N_2$ | 800 | | | (n-type) |
| | | $PH_3/GeH_4$ | $1 \times 10^{-1}$ | | | |
| 18 | Amorphous GeO | $GeH_4$ | 100 | 1.0 | 100 | $10^{11}$ |
| | | $O_2$ | 200 | | | (i-type) |
| | | $GeH_4$ | 100 | 1.0 | 100 | $10^9$ |
| | | $O_2$ | 200 | | | (p-type) |
| | | $B_2H_6/GeH_4$ | $1 \times 10^{-5}$ | | | |
| | | $GeH_4$ | 100 | 1.0 | 100 | $10^6$ |
| | | $O_2$ | 200 | | | (p-type) |
| | | $B_2H_6/GeH_4$ | $1 \times 10^{-2}$ | | | |
| | | $GeH_4$ | 100 | 1.0 | 100 | $10^9$ |
| | | $O_2$ | 200 | | | (n-type) |
| | | $PH_3/GeH_4$ | $1 \times 10^{-5}$ | | | |
| | | $GeH_4$ | 100 | 1.0 | 100 | $10^6$ |
| | | $O_2$ | 200 | | | (n-type) |
| | | $PH_3/GeH_4$ | $1 \times 10^{-2}$ | | | |

It is to be noted that in the table 1 above, the specific numbers given and the ingredient gases other than those including one of Al, B, C, Si, Ge, Ti, and W are only exemplary, so that, for example, $CH_4$ can be replaced by $C_2H_6$ or $C_2H_2$, and $N_2$ can be replaced by $NH_3$.

Also, for Diamond it is necessary to have the base material temperature of approximately 800° C. as oppose to that for the others which is typically about 500° C. It is to be noted here that for Diamond the pressure and the power is also greater than the typical values given for the others, and by reducing these to the typical values either the amorphous carbon or the graphite will be obtained.

Also, for BN and BC in the table 1, when the other ingredients include $B_2H_6$, 1 to 40 atomic% of hydrogen is also included, whereas when the other ingredients include $BF_3$, 1 to 40 atomic% of F is also included. In general, the ceramics becomes harder as the amount of H or F included is reduced, and in such a case the base material temperature and the power are usually increased.

Figure 8:
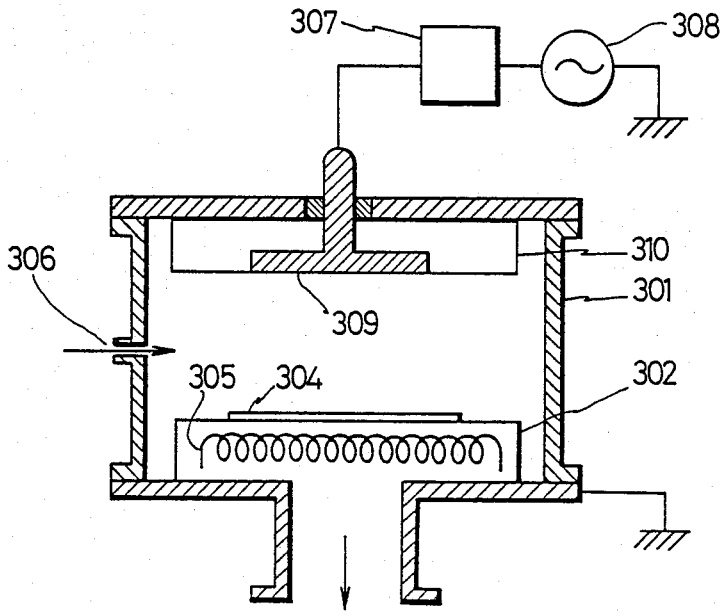
FIG. 8 is a schematic sectional view of a sputtering coating apparatus for ceramics coatings to be used in the present invention.

FIG. 8 shows the sputtering coating apparatus for the coating of the elastic blade that can be used in the present invention.

This sputtering coating apparatus is similar to the plasma CVD coating apparatus explained above except that it utilizes a solid raw material called target to which the high frequency or direct voltage is applied.

Thus, in this sputtering coating apparatus shown in FIG. 8, inside a vacuum chamber 301 there is provided a grounded plate electrode 302 and a solid raw material target 303 facing to each other, and a base material 304 such as a metallic elastic blade is to be placed on top of the grounded plate electrode 302. The vacuum chamber 301 is evacuated to be at approximately $10^{-3}$ Torr by means of a vacuum pump not shown, and then the base material 304 is heated up to approximately 150°–450° C. by means of a heater 305 installed in the grounded plate electrode 302. After that, the ingredient gases including argon (Ar) are injected into the vacuum chamber 301 through a gas injection opening 306 while continuing to evacuate the vacuum chamber 301 to maintain its pressure inside at 0.05–1.0 Torr, and the power is supplied from a high frequency power source 308 through a matching box 307 to the solid raw material target 303. As a result, the glow discharge is induced between the grounded plate electrode 102 and the solid raw material target 103, and Ar ions in the ingredient gases turned into the plasma state by the glow discharge strike out atoms or molecules from the solid raw material target 103 which interact with the plasma ingredient gases to form a thin ceramic layer on the surface of the base material 104.

The various ingredient gases that can be used in the sputtering coating for the purpose of the present invention along with the exemplary conditions to be used for each are summarized in the following table 2.

TABLE 2

| No. | Ceramics | Target | Ingredient gases | Gas flow rate (SCCM) | Pressure (Torr) | Power (W) |
|---|---|---|---|---|---|---|
| 1 | TiN | Ti | Ar<br>$N_2$ | 10<br>50 | $1 \times 10^{-3}$ | 800 |
| 2 | TiC | Ti | Ar<br>$CH_4$ | 10<br>100 | $1 \times 10^{-3}$ | 800 |
| 3 | $Al_2O_3$ | $Al_2O_3$-sinter | Ar | 10 | $1 \times 10^{-3}$ | 800 |
| 4 | BN | BN-crystal | Ar | 10 | $1 \times 10^{-3}$ | 800 |
| 5 | SiC | SiC-sinter | Ar | 10 | $1 \times 10^{-3}$ | 500 |
| | | Si-crystal | Ar<br>$CH_4$ | 10<br>50 | $1 \times 10^{-3}$ | 500 |
| 6 | SiN | SiN-sinter | Ar | 10 | $1 \times 10^{-3}$ | 500 |
| | | Si-crystal | Ar<br>$NH_3$ | 10<br>50 | $1 \times 10^{-3}$ | 500 |
| 7 | SiO | SiO | Ar | 10 | $1 \times 10^{-3}$ | 500 |

Now, some results of the tests which clearly exhibit the effect of the present invention are discussed.

[TEST 1]

The elastic blades made of SUS304 stainless is coated with the ceramic including Al of approximately 0.1 to 20 μm thickness, by means of the plasma CVD coating apparatus shown in FIG. 5.

Meanwhile, the aluminium developing roller whose surface is sandblasted to have the roughness of 3.0 μmRz is coated with the ceramic including Al of approximately 0.1 to 20 μm thickness, by means of the plasma CVD coating apparatus shown in FIGS. 6 and 7.

These elastic blade and the developing roller are installed in the image developing apparatus of the copy machine shown in FIG. 1, and one hundred thousand copies are taken with the non-magnetic single component toner containing 10 weight% of the magnetic powder, under 20 kg load.

In this test, the satisfactory images are obtained throughout the one hundred thousand copies, and no change was observed on the roughness of the ceramics coating layers, both of the elastic blade and the developing roller. Furthermore, the driving torque in the image developing operation was measured to be 1.8 kg cm.

The same test repeated with the elastic blade and the developing roller coated with the ceramic including Si instead of Al showed the identical result. In addition, in this case, no contamination of the inside of the copy machine due to the scattering of the toner was observed.

Also, these results were unaffected when the coating of the elastic blade was changed to that with the ceramic including Ti instead of Al or Si.

On the other hand, the same test repeated with the elastic blade and the developing roller coated with the Ni electroless platings showed the abrasion of 2.0 μm at the contacting portions of the elastic blade and the developing roller, as well as the reduction in the roughness of the surface of the developing roller from 3.0 μmRz to 0.6 μmRz which caused the decrease in the amount of the toner conveyed, resulting in poorer images. Moreover, the driving torque in the image developing operation was measured to be 2.5 kg cm.

These tests with different kinds of coatings are also repeated with the positively electrifiable non-magnetic single component toner comprising styrene-acrylonitrile copolymer with 4 weight% of carbon and 4 weight% of other additives, to yield the identical results. In addition, the electrification of the toner were measured to be 12 μC/g with the ceramics coating as oppose to 10 μC/g with the electroless platings.

[TEST 2]

The same tests as that performed with Si in TEST 1 discussed above were further performed with the coating of the elastic blade and the developing roller by the ceramics including the amorphous Si and amorphous silicon carbide which were formed under the various conditions given in the table 1 above, from which the most preferable combinations among various types of the toner and the ceramics as shown in the following table 3 are obtained.

TABLE 3

| No. in Table 1 | Preferable Toner Type | Resistivity (cm) | Effect |
|---|---|---|---|
| 11a | poorly electrifiable | $1\text{-}2 \times 10^{12}$ | less fog, more image density. |

TABLE 3-continued

| No. in Table 1 | Preferable Toner Type | Resistivity (cm) | Effect |
|---|---|---|---|
| 11b | moderately electrifiable | 3-8 $\times 10^{11}$ | less fog. |
| 11c | easily electrifiable | 1-2 $\times 10^{11}$ | less fog, more image density. |
| 11d | moderately electrifiable | 3-8 $\times 10^{11}$ | less fog. |
| 11e | easily electrifiable | 1-2 $\times 10^{11}$ | more image density. |
| 12a | very poorly electrifiable, containing $SiO_2$ or likes | $1 \times 10^{12}$-$1 \times 10^{13}$ | less fog, no abrasion of elastic blade. |
| 12c | easily electrifiable, containing $SiO_2$, SiC or likes | $1 \times 10^{10}$-$1 \times 10^{11}$ | more image density, no abrasion of elastic blade. |
| 12e | easily electrifiable, containing $SiO_2$, SiC or likes | $1 \times 10^{10}$-$1 \times 10^{11}$ | more image density, no abrasion of elastic blade. |

As explained, according to the present invention, it is possible to obtain high quality images without a fog even with the poorly electrifiable toner over the extended period of time, as well as to reduce the driving torque in the image developing operation, by coating at least one of the elastic blade and the developing roller with the ceramics including at least one of Al, B, C, Si, Ge, Ti and W. These ceramics enable the reductions of the abrasion in the elastic blade and the developing roller because of their hardness, and of the driving torque in the image developing operation because of their low friction coefficients. Moreover, the ceramics including at least one of Al, B, and C can electrify the toner very well so that a rather poorly electrifiable toner can be used, while the ceramics including at least one of Ge and Si can have variable electric resistances so that they can be adjusted in accordance with the electrifiability of the toner. This latter type of ceramics are also characterized by that the toner can easily be rubbed on and the image density can be made large. On the other hand, the ceramics including at least one of the Ti and W are characterized by that the image density can also be made large. For instance, TiN is coated on the roller in order to lengthen its life while the blade is coated with an insulating material such as $Al_2O_3$, BN or the like in order to obtain the sufficient toner.

It is to be noted that many modifications and variations of these embodiments may be made without departing from the novel and advantageous features of the present invention. Accordingly, all such modifications and variations are intended to be included within the scope of the appended claims.

What is claimed is:

1. An image developing apparatus, comprising:
image bearer means for bearing a latent image;
toner conveyer means for conveying non-magnetic single component toner to the image bearer means in order to develop the latent image, the toner conveyer means having its surface coated with a ceramic; and
lamination controller means for controlling a thickness of non-magnetic single component toner lamina to be formed on the toner conveyer means.

2. The image developing apparatus of claim 1, wherein the ceramic includes at least one of Al, B, and C.

3. The image developing apparatus of claim 1, wherein the ceramic includes at least one of Si and Ge.

4. The image developing apparatus of claim 1, wherein the ceramic includes at least one of Ti and W.

5. The image developing apparatus of claim 3, wherein the ceramic further includes at least one of atoms in the III and V groups of the periodic table.

6. The image developing apparatus of claim 2, wherein the ceramic further includes at least one of N, 0, H, and halogen.

7. The image developing apparatus of claim 5, wherein the ceramic further includes at least one of N, 0, H, and halogen.

8. The image developing apparatus of claim 6, wherein the ceramic contains 1 to 40 atomic% of one of H and halogen.

9. The image developing apparatus of claim 7, wherein the ceramic contains 1 to 40 atomic% of one of H and halogen.

10. An image developing apparatus, comprising:
image bearer means for bearing a latent image;
toner conveyer means for conveying non-magnetic single component toner to the image bearer means in order to develop the latent image; and
lamination controller means for controlling a thickness of non-magnetic single component toner lamina to be formed on the toner conveyer means, the lamination controller means having its surface coated with a ceramic.

11. The image developing apparatus of claim 10, wherein the ceramic includes at least one of Ti and W.

12. The image developing apparatus of claim 10, wherein the ceramic includes at least one of Al, B, and C.

13. The image developing apparatus of claim 10, wherein the ceramic includes at least one of Si and Ge.

14. The image developing apparatus of claim 13, wherein the ceramic further includes at least one of atoms in the III and V groups of the periodic table.

15. The image developing apparatus of claim 11, wherein the ceramic further includes at least one of N, 0, H, and halogen.

16. The image developing apparatus of claim 12, wherein the ceramic further includes at least one of N, 0, H, and halogen.

17. The image developing apparatus of claim 14, wherein the ceramic further includes at least one of N, 0, H, and halogen.

18. The image developing apparatus of claim 15, wherein the ceramic contains 1 to 40 atomic% of one of H and halogen.

19. The image developing apparatus of claim 16, wherein the ceramic contains 1 to 40 atomic% of one of H and halogen.

20. The image developing apparatus of claim 17, wherein the ceramic contains 1 to 40 atomic% of one of H and halogen.

* * * * *